US005423928A

United States Patent [19]

Hambright

[11] Patent Number: 5,423,928

[45] Date of Patent: Jun. 13, 1995

[54] PROCESS FOR CREATING TRANSFERRABLE PILE YARN DESIGNS

[76] Inventor: Perry Hambright, 22543 Ventura Blvd., Woodland Hills, Calif. 91364

[21] Appl. No.: 59,896

[22] Filed: May 10, 1993

[51] Int. Cl.[6] ..... B29C 65/52; D05C 15/06; D05C 17/00

[52] U.S. Cl. ..... 156/72; 112/266.2; 156/230

[58] Field of Search ..... 156/72, 230, 240, 241, 156/435; 428/78, 79, 88, 92, 93, 94, 95, 96; 2/244, 246; 112/410, 411, 266.1, 266.2, 80.03, 80.06

[56] References Cited

U.S. PATENT DOCUMENTS

| | | | |
|---|---|---|---|
| 735,575 | 8/1903 | Pauly | 112/266.1 |
| 869,407 | 10/1907 | Baird | 112/80.06 |
| 1,096,302 | 5/1914 | Heymann | 156/435 |
| 1,945,700 | 2/1934 | Brien et al. | 156/435 |
| 2,639,250 | 5/1953 | Reinhardt | 428/94 |
| 2,983,028 | 5/1961 | Cole | 112/410 |
| 3,266,969 | 8/1966 | Makansi | 156/435 |
| 3,309,252 | 3/1967 | Alder | 156/435 |
| 3,444,017 | 5/1969 | Kleinermanns | 156/435 |
| 3,570,435 | 3/1971 | Morrison | 112/266.1 |
| 3,944,452 | 3/1976 | Toland et al. | 156/72 |
| 4,015,036 | 3/1977 | Haemer | 428/88 |
| 4,292,100 | 9/1981 | Higashiguchi | 156/230 |
| 4,788,922 | 12/1988 | Clarius | 2/244 |
| 4,911,773 | 3/1990 | Leighton | 156/94 |

FOREIGN PATENT DOCUMENTS

| | | | |
|---|---|---|---|
| 2190882 | 12/1987 | Germany | 428/92 |

OTHER PUBLICATIONS

The Art of Doing: Textile Techniques, pp. 37–49, 1985.

*Primary Examiner*—Michael W. Ball
*Assistant Examiner*—Steven D. Maki
*Attorney, Agent, or Firm*—Kelly, Bauersfeld & Lowry

[57] ABSTRACT

A process for creating a pile yarn design and transferring it to a substratum, such as an article of clothing, involves the creation of the design on a temporary supporting medium, utilizing the medium to secure the design to the substratum, and then removing the medium from the pile yarn design. More particularly, a thin sheet of non-stick, moisture-proof plastic sheet material is stretched within a peripheral support, such as an embroidery hoop. Lengths of yarn are placed over the pattern, and a tweezer tool is utilized to punch the yarn through the plastic sheet so that loops extend outwardly from a side thereof. This process is utilized to create the pile yarn design on the plastic sheet. When the design is completed, glue is applied over a base portion of the pile yarn design, and the plastic sheet medium is then utilized to place the glue-coated yarn base portions into contact with the substratum. After the glue has dried, the plastic sheet is simply pulled upwardly off the loops, leaving the pile yarn design securely fixed to the substratum.

12 Claims, 3 Drawing Sheets

FIG. 8
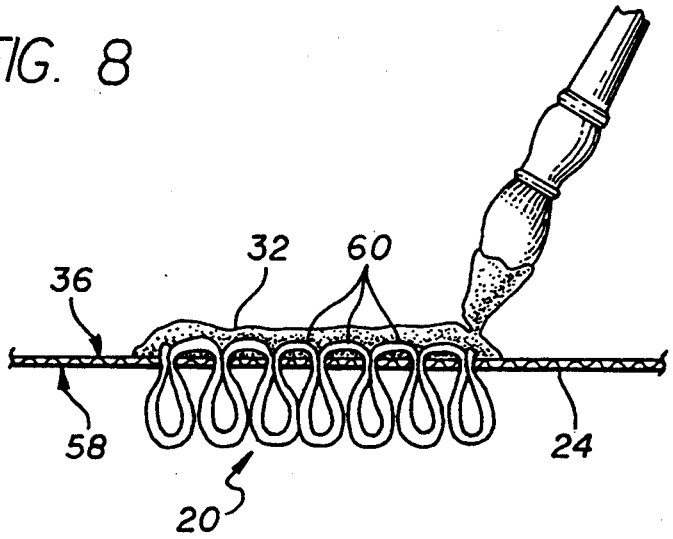
FIG. 9
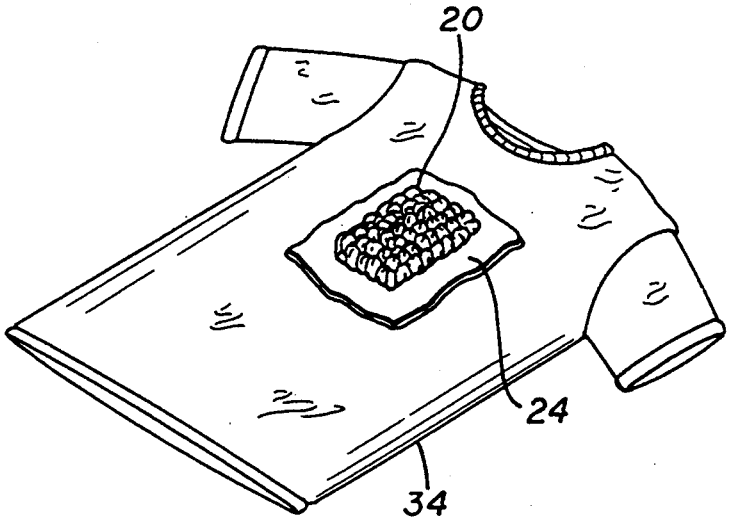
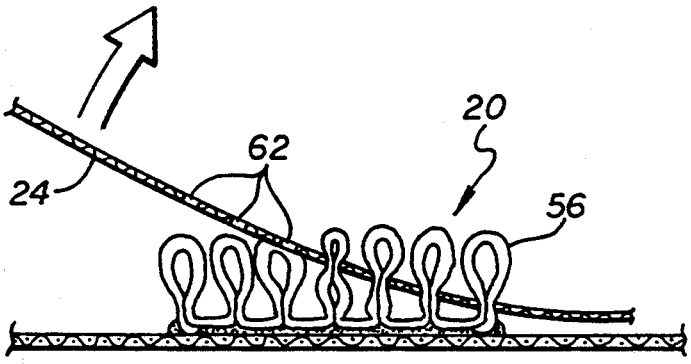
FIG. 10

PROCESS FOR CREATING TRANSFERRABLE PILE YARN DESIGNS

BACKGROUND OF THE INVENTION

This invention relates generally to handicrafts. More specifically, the present invention relates to a process for creating a yarn pile design on a temporary supporting medium, utilizing that temporary medium to secure the created pile yarn design permanently to a selected substratum, and then removing the medium from the assembly of the design and the underlying substratum.

Most carpet is made with looped pile yarn. A machine typically punches loops of a continuous yarn strand into a burlap-type fabric. A stabilization coating of some type of glue is applied to the back of the carpet so the loops will not easily pull out of the fabric.

Punched rugs (normally done by hand) are made by punching loops of continuous yarn or fabric strips into a burlap-type fabric. With punched rugs, in contrast with other types of carpet, the yarn loops are placed into the fabric with a hand held punch needle comprising a sharpened tube with a hole on the side near the pointed tip. Usually there is an outlined design on the fabric that is used as a guide. Various areas of the design are filled in with different colors of yarn to create a pile design on the opposite side of the fabric. As with carpet, a glue is applied to the back or non-pile side of the burlap-type fabric so as to bind the yarn loops to the fabric.

Another pile design craft is punch embroidery. This utilizes virtually the same technique as that described above in connection with punched rugs, except that the yarn is very fine, giving the crafter a more detailed design and more delicate finished crafts for other uses. Both methods offer the ability to vary the length of the pile by varying the length of the punch needle.

While the punched rug and punch embroidery techniques permit a crafter to create an attractive pile yarn design which may be tailored to suit individual preferences and needs, should the crafter desire to apply the created yarn pile design to a secondary substratum, such as an article of clothing, there has generally been no alternative other than to affix the fabric or primary substratum directly to the article of clothing. There has not been an acceptable process which permits the crafter to first create the yarn pile design, and then apply it directly to a selected substratum, such as an article of clothing, without also requiring that the fabric or primary substratum used to create the yarn pile design also be applied to the clothing article.

Accordingly, there has been a need for a novel process for creating a pile yarn design and then transferring it to a selected substratum directly. Such a process should be easy to understand and implement, and utilize familiar crafting techniques. Additionally, a process for transferring a pile yarn design to a selected substratum is needed which permits a crafter to create a desired pile yarn design on a temporary supporting medium, and then affix the pile yarn design directly to the substratum utilizing the temporary medium, after which the medium can be removed completely from the assembly of the pile yarn design and the underlying substratum. The present invention fulfills these needs and provides other related advantages.

SUMMARY OF THE INVENTION

The present invention resides in a novel process for transferring a pile yarn design to a substratum. This process broadly comprises the steps of creating the pile yarn design on a temporary supporting medium, utilizing the medium to secure the design to the substratum, and then removing the medium from the pile yarn design and the substratum.

In a preferred form of the invention, the process includes the steps of peripherally supporting the temporary supporting medium so that a working portion thereof lies substantial flat, and punching lengths of yarn through a first side of the temporary supporting medium according to a pattern printed thereon to create a pile design of yarn loops extending away from a second side thereof. An adhesive is then applied to a base portion of the yarn on the first side of the temporary supporting medium, and is then placed in contact with the substratum. The adhesive bonds the base portion of the yarn to the substratum, and after the bonding takes place between the yarn and the substratum, the medium is removed from the substratum while leaving the pile yarn design in place thereon.

More particularly, the step of peripherally supporting the temporary supporting medium includes the step of stretching a non-stick, moisture-proof sheet such as plastic, taut, utilizing an embroidery-type hoop on other open frame device. A color indicating pattern is imprinted on the first side of the plastic sheet within the working portion to guide punching of the yarn loops therethrough. One or more lengths of yarn are placed adjacent to the indicia on the pattern, and a punch tweezer is utilized to grasp the yarn and push a loop portion thereof through the plastic sheet. The punch tweezer includes means for limiting the extent to which the length of yarn may be pushed through the plastic sheet. Prior to applying the adhesive, loose ends of the yarn are cut near to the surface of the first side of the plastic sheet.

The adhesive is applied over the base portions of the strings of yarn so as to substantially completely cover the yarn exposed on the first side of the plastic sheet. The wet glue coated yarn is then placed into contact with a substratum and left to dry. After the adhesive coated base yarn portions have been bonded to the substratum, which may be a clothing article such as a T-shirt, the temporary supporting medium is removed by grasping an edge of the plastic sheet and pulling outwardly away from the substratum such that the non-stick plastic sheet releases from any dried glue and the yarn loops are pulled back out of the plastic sheet. This leaves the pile yarn design adhered to the substratum without the plastic sheet which can now be reused to produce and transfer other yarn pile designs of the same image.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 8 is a view similar to FIGS. 4–7, illustrating the step of applying glue over a base portion of the pile yarn design;

FIG. 9 is a perspective view of a T-shirt which provides a substratum onto which the plastic sheet is placed, wherein the glue is placed in direct contact with the a T-shirt and is allowed to dry; and FIG. 10 illustrates the step of removing the plastic sheet from the T-shirt and the pile yarn design, by simply pulling it upwardly and causing the yarn loops to pull out back through the plastic sheet once again.

DETAILED DESCRIPTION OF THE PREFERRED EMBODIMENT

Figure 1:
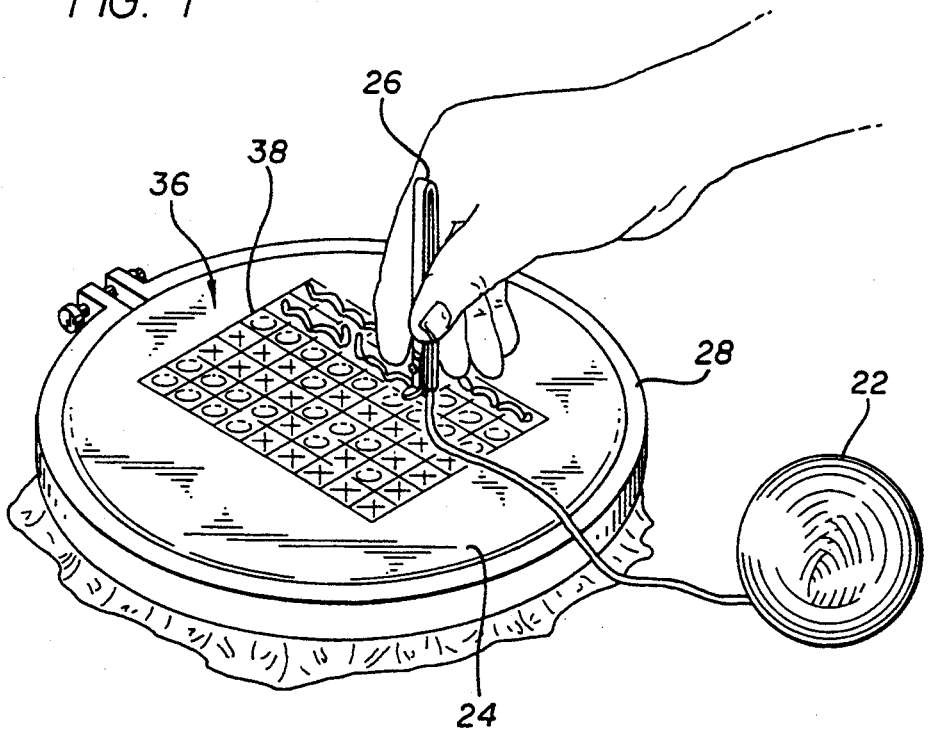
FIG. 1 is a perspective view of a temporary supporting medium comprising a non-stick, moisture-proof flexible sheet material such as plastic, having a color indicating pattern applied thereto, which is supported within an embroidery type hoop, wherein the step of creating a pile yarn design utilizing a punch tweezer tool is shown.

As shown in the drawings for purposes of illustration, the present invention is concerned with a process for creating a pile yarn design, generally designated by the reference number 20, and transferring it to a selected substratum such as an article of clothing. The novel process of the present invention involved the use of only a few selected materials and tools, but advantageously permits a crafter, utilizing normal handicraft techniques, to first create the pile yarn design 20 on a temporary supporting medium, and then affix the pile yarn design to the selected sub stratum in a manner which permits the temporary supporting medium to be removed from the pile yarn design.

The crafter utilizing the process for creating transferable pile yarn designs of the present invention need possess only a few basic craft items and tools. In accordance with the present invention, and as illustrated in connection with a preferred process, prior to practicing the process of the present invention the crafter need only secure one or more quantities of yarn 22, a temporary supporting medium such as a thin plastic sheet 24 with a preprinted pattern, a punch tweezer tool 26, means for peripherally supporting the plastic sheet so that a working portion thereof can be stretched substantially flat (such as an embroidery hoop 28), which is shown, in FIG. 1, in the form of a generally circular embroidery hoop 28, scissors 30, a permanent adhesive or glue 32, and the surface to which the created pile yarn design 20 is to be transferred which, in the illustrated embodiment, comprises a T-shirt 34.

After the required materials have been assembled, the crafter begins the process of the present invention by stretching the plastic sheet 24 onto the embroidery hoop 28, or another similar open frame device. The plastic sheet 24 is preferably made of a tough but flexible sheeting material such as a thick mil polyurethane, which is moisture-proof and will not stick to the glue 32. The plastic sheet 24 has printed on an upper surface 36 thereof an image 38 to guide the crafter in the creation of the pile yarn design 20 on the plastic sheet 24. As with other punch methods, the embroidery hoop 28 might have short legs (not shown) on the back in order to hold the plastic sheet 24 a few inches off a table surface, or it might be placed to bridge two stacks of books to achieve the same raised position.

As shown in FIG. 1, the image 38 is provided in a charted or grid format of color coded symbols but, of course, it could be printed in color with colored dots to indicate yarn color. A common grid count would be approximately seven squares per inch, and the image 38 is printed onto the plastic sheet 24 so as to be placed within the embroidery hoop 28. The crafter looks at and works on a mirror image of what the final pile yarn design 20 will be.

Figure 2:
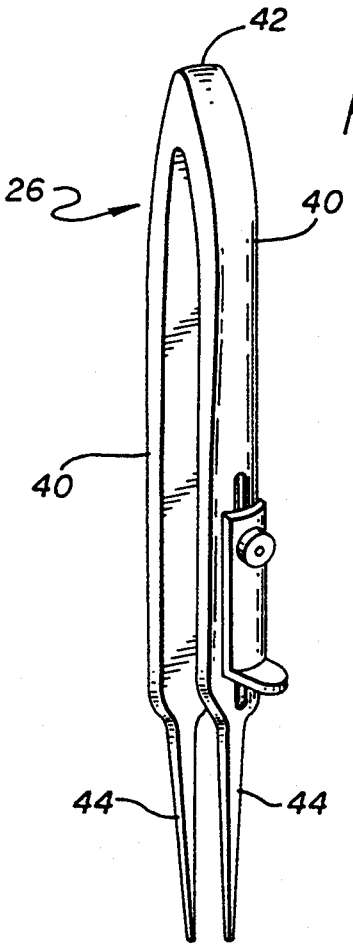
FIG. 2 is an enlarged perspective view of the punch tweezer tool shown in FIG. 1.
Figure 3:
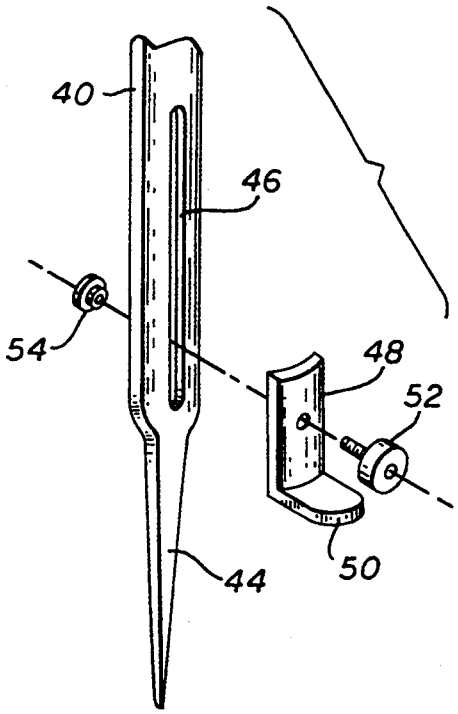
FIG. 3 is an enlarged, fragmented exploded view of the lower portion of the punch tweezer tool shown in FIG. 2, illustrating the assembly of a slidable stop to a leg of the tool.
Figure 4:
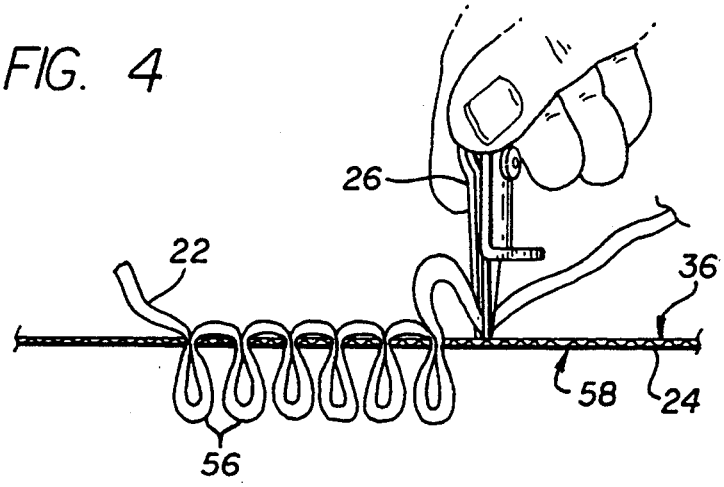
FIG. 4 illustrates the step of grasping a portion of a length of yarn with the punch tweezer tool and aligning a tip of the tool with the indicia provided by the pattern on a first side of the plastic sheet.
Figure 5:
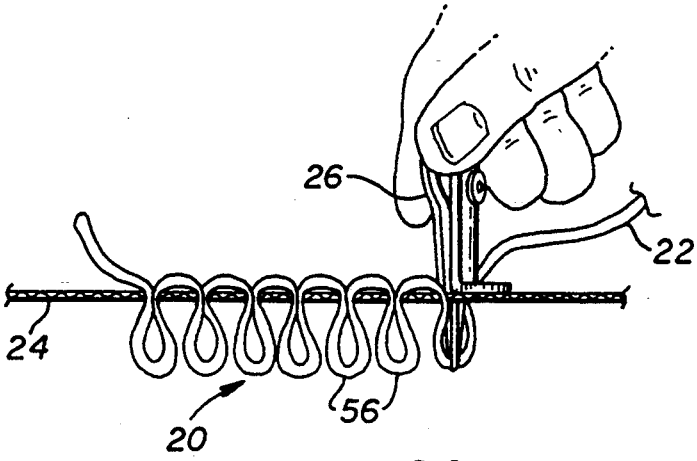
FIG. 5 is a view similar to FIG. 4, illustrating the manner in which the punch tweezer tool is utilized to punch a hole through the plastic sheet and create a loop of yarn material extending away from a second side thereof, wherein the slidable stop of the punch tweezer tool ensures uniform height of the yarn loops.
Figure 6:
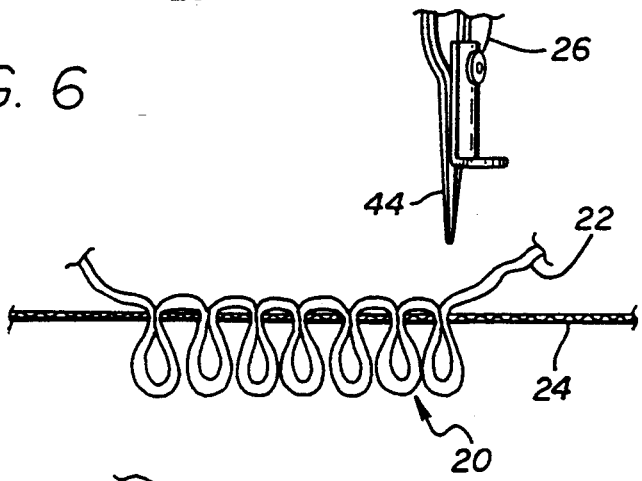
FIG. 6 is a view similar to FIGS. 4 and 5, illustrating withdrawal of the needle nose tip of the punch tweezer tool from the plastic material to leave the yarn loop held in place by the tight hole.

With the plastic sheet 24 stretched taut within the embroidery hoop 28, the crafter is ready to secure the yarn 22 temporarily onto the plastic sheet 24. To accomplish this, the punch tweezer tool 26 is utilized (see FIGS. 2 and 3). The punch tweezer tool 26 is similar to standard tweezers in that it comprises, generally, a pair of spaced apart elongated legs 40 which are joined together at a junction 42 at one end. Each leg 40 is provided with a needle nose tip 44 opposite the junction 42, which may be flexed inwardly to grasp items such as the yarn 22. When force is removed from the legs 40, the tips 44 resiliently move apart from one another.

One of the legs 40 is provided with a longitudinally extending slot 46 for adjustably positioning a slidable stop 48 on that leg. The slidable stop 48 includes a stop flange 50 which extends perpendicularity outwardly away from the respective leg 40. The slidable stop is secured within the slot 46 by means of a small bolt 52 and nut 54. The stop flange 50 is set relative to the needle nose tip 44 to limit the extent to which a length of yarn 22 may be pushed through the plastic sheet 24 utilizing the punch tweezer tool 26.

With reference to FIGS. 1 and 4–6, creation of the pile yarn design 20 on the plastic sheet 24 begins by placing a selected length of yarn 22 over one of the rows provided in the grid pattern 38 on the upper surface 36 of the plastic sheet. A first loop 56 of yarn is created in the upper left grid square of the image 38 (or upper right if you are left handed), and is of the color of yarn called for by the symbol within that grid square of the printed image. A small dot may be provided in the center of the grid squares to give the crafter the exact placement of the hole that will be punched through the plastic sheet 24 utilizing the punch tweezer tool 26.

Once a loop 56 of yarn has been pushed through the plastic sheet 24 so that the loop extends outwardly away from a second surface 58, of the plastic sheet 24, two strands of yarn will be seen to be sticking out from the upper surface 36 of the plastic sheet. One will be less then an inch long and the other will be the rest of the length of yarn 22. This remaining length of yarn should be coming from the right side of the hole (if right handed), and it should be laid on the upper surface 36 over the image 38 so that it covers the rest of the grid squares on the first horizontal row.

The length of yarn 22 is then grabbed by the needle nose tips 44 of the punch tweezer tool 26 exactly at the second grid dot to the right of the previously made loop 56. In some instances it might be desirable to grab the length of yarn 22 at the first or third grid dots depending on the pile height the crafter desires. Grabbing the yarn at a selected point will set the general length of the loop 56. The stop flange 50 provided on the punch tweezer tool 26 will set the exact length of the loops 56.

After the yarn is grasped by the tweezer tool 26, the tips 44 and the grasped portion of the length of yarn 22 are punched through the plastic sheet 24 within the second grid square adjacent to the first. The needle nose tips 44 of the punch tweezer tool 26 are inserted fully through the plastic sheet 24 until the upper surface 36 thereof comes into contact with the stop flange 50. The crafter then releases the grip on the string of yarn 22 and simply pulls the tweezer tool 26 upwardly to remove the tips 44 from the plastic sheet 24 and yet leave the newly created loop in place. This process may be repeated any number of times to create a plurality of uniform yarn loops adjacent to one another which extend downwardly from the second surface 58 of the plastic sheet 24.

It will be appreciated that the needle nose tips 44 of the punch tweezer tool 26 are utilized to actually punch a hole through the plastic sheet 24 at locations determined by the image 38 printed thereon. Because of the nature of the plastic sheet 24, after a pile yarn design 20 had been created thereon and then transferred to a desired substratum such as the T-shirt 34, the same plastic sheet 24 may be reused. The plastic sheet 24 advantageously remains tight around the base of the yarn loop 56 after the punch tweezer tool 26 has been withdrawn to securely, yet temporarily, hold each loop 56 in place.

Assuming that the color of the yarn 22 needs to be changed for the next subsequent loop 56 according to the printed image 38 on the upper surface 36 of the plastic sheet 24, the length of yarn 22 is simply clipped near to the surface of the plastic sheet, and the process explained above is repeated with a new length of yarn of a different desired color. Before clipping the length of yarn 22, however, it is recommended that the hoop 28 be turned over and the created loops 56 be checked for uniformity. The method of the present invention almost always forms perfectly shaped loops 56, but an occasional "small" loop may appear. In this case, the small loop 56 is simply grasped by the punch tweezer tool 26, and pulled out a bit. If this changes the heights of the adjacent loops 56, then they are also likewise adjusted until the loops 56 all have a uniform appearance.

Figure 7:
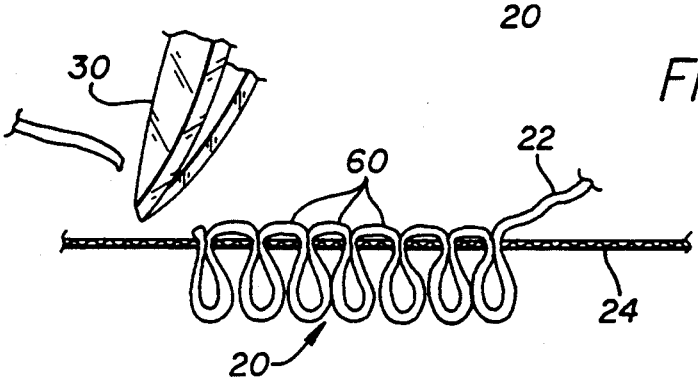
FIG. 7 is a view similar to FIGS. 4–6 illustrating the step of clipping the loose ends of the yarn near to the surface of the plastic sheet.

Going back to the upper surface 36 of the plastic sheet 24, the loose ends of the lengths of yarn 22 are trimmed with the scissors 30 so that little or no remaining loose yarn is visible (see FIG. 7). The loose ends of the lengths of yarn 22 are cut right at the work level, approximately one-sixteenth of an inch from the surface 36, but because of the resiliently flexible nature of the plastic sheet 24, the created loops 56 will not pull-out unless tugged at.

Once the ends of the first color of yarn 22 are cut, the crafter simply gets the next color of yarn and proceeds with creating loops 56 as before. Once the end of a horizontal row has been reached, the loose ends are clipped and the next row below it is started. As the process proceeds, a tight base portion 60 of the pile yarn design 20 will lie adjacent to the upper surface 36 of the plastic sheet 24, while the plush, looped pile yarn design 20 itself will be formed adjacent to the lower second surface 58 thereof.

After the pile yarn design 20 has been created on the plastic sheet 24, the next step involves transferring the created pile yarn design 20 to a selected substratum, such as the T-shirt 34. This is achieved by painting the glue 32 (which dries soft and remains flexible) directly over the base portion 60 of the pile yarn design 20. This may or may not be done after the plastic sheet 24 bearing a pile yarn design 20 has been removed from the embroidery hoop 28. The yarn fibers adjacent to the upper surface 36 of the plastic sheet 24 may be completely soaked with the glue 32, and yet the loops 56 formed and extending away from the second surface 58 remain dry.

While the glue 32 is still wet, the glue and the base portion 60 of the pile yarn design 20 is placed over the selected location on the T-shirt 34 (FIG. 9). When working with fabrics it is often desirable to lay something flat and heavy (like a large book) directly over the pile yarn design 20 to ensure that good contact is made between the glue coated base portion 60 of the pile yarn design 20 and the underlying T-shirt 34. Also, some kind of glue barrier such as a piece of cardboard should be placed inside the T-shirt so the glue will not soak through to the back.

After the glue has dried, the plastic sheet 24 is removed from the pile yarn design 20 by simply grasping an edge of the plastic sheet 24 and pulling it upwardly away from the T-shirt 34 (FIG. 10). The base portion 60 of the pile yarn design 20 is strongly secured to the T-shirt 34 and, although the glue 32 may have come into contact with the plastic sheet 24, the sheet is of such a material that the glue does not adhere to it. Therefore, the plastic sheet 24 may be easily pulled off of both the underlying T-shirt 34 and the pile yarn design 20. The loops 56 pull right back out of the punched holes 62. This leaves the pile yarn design 20 only, with no intermediate materials, permanently adhered to the T-shirt 34.

From the foregoing it is to be appreciated that the process for creating a pile yarn design 20 and transferring it to a substratum, such as the T-shirt 34, described above, can be worked in various yarn pile heights, even within the same design, and can be put onto fabrics for pillows, rugs, wall hangings, placemats or the like. When utilized in connection with garments, the pile yarn design 20 can be applied directly to the garment or on to a separate fabric which is then cut out as a repositionable applique. The yarn loops 56 of the pile yarn design 20 so created may be clipped if desired for a velvety look, or left looped for a nubby look.

Although a particular embodiment of the invention has been described in detail for the purposes of illustration, various modifications may be made without departing from the spirit and scope of the invention. Accordingly, the invention is not to be limited, except as by the appended claims.

I claim:

1. A handicraft process for creating a pile yarn design and transferring it to a substratum, comprising the steps of:

peripherally supporting a flexible sheet so that a working portion of the flexible sheet lies substantially flat;

punching a length of yarn through a first side of the flexible sheet to create yarn loops extending away from a second side of the flexible sheet, the yarn loops forming a looped pile yarn design;

applying an adhesive over a base portion of the looped pile yarn design and the first side of the flexible sheet such that the adhesive does not adhere to the flexible sheet;

placing the first side of the flexible sheet adjacent to the substratum;

bonding the base portion of the looped pile yarn design to the substratum; and removing the sheet from the substratum while leaving the looped pile yarn design in place thereon.

2. A process as set forth in claim 1, wherein the sheet is moisture-proof, and wherein the step of peripherally supporting the flexible sheet includes the step of stretching the moisture-proof sheet taut.

3. A process as set forth in claim 2, including the step of utilizing an embroidery hoop to peripherally support the flexible sheet.

4. A process as set forth in claim 1, wherein the flexible sheet is moisture-proof, and including the step of printing a pattern on the first side of the flexible sheet to provide indicia for guiding the punching of the length of yarn therethrough.

5. A process as set forth in claim 4, including the steps of placing the length of yarn adjacent to the pattern, and punching the length of yarn through the flexible sheet in accordance with the indicia.

6. A process as set forth in claim 5, including the steps of utilizing a punch tweezer to grasp the length of yarn and push a loop portion thereof through the flexible sheet.

7. A process as set forth in claim 6, including the step of limiting the extent to which the length of yarn is pushed through the sheet utilizing the punch tweezer.

8. A process as set forth in claim 6, including the step of cutting the length of yarn near to the surface of the first side of the flexible sheet.

9. A process as set forth in claim 1, wherein the step of applying adhesive over the base portion of the looped pile yarn design includes the step of utilizing a brush to paint the adhesive thereon so as to substantially completely cover the base portion of the looped pile yarn design.

10. A process as set forth in claim 1, wherein the step of removing the sheet includes the step of grasping an edge of the sheet and pulling it outwardly away from the substratum such that the yarn loops pull back out of the sheet.

11. A process for creating a pile yarn design and transferring it to a clothing article, comprising the steps of:

printing a pattern onto a first side of a flexible plastic sheet;

peripherally anchoring the plastic sheet within an embroidery hoop so that a working portion of the plastic sheet is stretched substantially flat;

placing a length of yarn adjacent to the pattern;

punching the length of yarn through the plastic sheet in accordance with the pattern utilizing a punch tweezer to create yarn loops extending away from a second side of a plastic sheet which form a looped pile yarn design;

painting an adhesive over a base portion of the looped pile yarn design adjacent to the first side of the plastic sheet so as to substantially completely cover the base portion of the looped pile yarn design;

placing the first side of the plastic sheet adjacent to the clothing article;

bonding the base portion of the looped pile yarn design to the clothing article; and removing the plastic sheet from the clothing article while leaving the looped pile yarn design in place thereon by grasping an edge of a plastic sheet and pulling it outwardly away from the clothing article such that the yarn loops pull back out of the plastic sheet.

12. A process as set forth in claim 11, wherein the plastic sheet is moisture-proof, and wherein the adhesive does not adhere to the plastic sheet.

* * * * *

UNITED STATES PATENT AND TRADEMARK OFFICE

CERTIFICATE OF CORRECTION

PATENT NO. : 5,423,928

DATED : June 13, 1995

INVENTOR(S) : Perry Hambright

It is certified that error appears in the above-identified patent and that said Letters Patent is hereby corrected as shown below:

In column 7, line 33, delete "indicia" and insert --pattern--.

Signed and Sealed this

Second Day of January, 1996

Bruce Lehman

*Attest:*

BRUCE LEHMAN

*Attesting Officer*

*Commissioner of Patents and Trademarks*